US006273202B1

(12) United States Patent
Zamfes

(10) Patent No.: US 6,273,202 B1
(45) Date of Patent: Aug. 14, 2001

(54) SWAB TEST FOR DETERMINING RELATIVE FORMATION PRODUCTIVITY

(76) Inventor: Konstandinos S. Zamfes, 1830-10$^{th}$ Avenue, S.W., Calgary, Alberta (CA), T3C 0J8

( * ) Notice: Subject to any disclaimer, the term of this patent is extended or adjusted under 35 U.S.C. 154(b) by 0 days.

(21) Appl. No.: 09/461,021

(22) Filed: Dec. 15, 1999

(30) Foreign Application Priority Data

Dec. 16, 1998 (CA) ..... 2256258

(51) Int. Cl.$^{7}$ ..... E21B 49/00

(52) U.S. Cl. ..... 175/50; 73/152.42; 73/152.46; 166/250.16

(58) Field of Search ..... 175/50, 40; 166/250.16; 73/152.42, 152.46

(56) References Cited

U.S. PATENT DOCUMENTS

| | | | | |
|---|---|---|---|---|
| 4,498,536 | * | 2/1985 | Ross et al. | 166/250 |
| 4,691,772 | | 9/1987 | Ebenhack et al. . | |
| 4,775,991 | | 10/1988 | Staudinger et al. . | |
| 4,878,382 | * | 11/1989 | Jones et al. | 175/40 |
| 5,070,949 | * | 12/1991 | Gavignet | 175/48 |
| 5,115,871 | * | 5/1992 | McCann et al. | 175/50 |
| 5,181,419 | | 1/1993 | Thompson . | |
| 5,306,909 | | 4/1994 | Jones et al. . | |
| 5,463,549 | | 10/1995 | Dussan et al. . | |
| 6,148,912 | * | 11/2000 | Ward | 166/250.07 |

FOREIGN PATENT DOCUMENTS 1316525 4/1993 (CA) .

* cited by examiner

*Primary Examiner*—Hoang Dang
(74) *Attorney, Agent, or Firm*—Sean W. Goodwin

(57) ABSTRACT

The productivity of a formation is determined by stroking the drill bit up and down (swabbing) in the zone of interest for creating a suction in the wellbore and inducing the flow of hydrocarbons from the formation. The drilling mud 15 is first circulated to deplete hydrocarbon gas from the mud 15, the zone is swabbed, and the mud 15 is again circulated and the quantity of hydrocarbon gas contained therein is measured for comparison against that known for predetermined productivity. Preferably, the swabbing is performed enough times to ensure measurable production regardless of filter cake or invasion.

7 Claims, 3 Drawing Sheets

SWAB TEST FOR DETERMINING RELATIVE FORMATION PRODUCTIVITY

FIELD OF THE INVENTION

This invention relates to the field of wellbore drilling and more particularly to the field of downhole operations for the purposes of establishing performance or productivity of a zone of interest in a formation.

BACKGROUND OF THE INVENTION

Having reference to FIG. 1, a wellbore is been drilled to or through a formation or zone of interest. The zone of interest is sometimes identified roughly by a localized increase in the drill bit's rate of penetration ("ROP") or by a the detection of hydrocarbon gas with at a total gas ("TG") detector, which draws a sample of gas carried by the drilling mud when it returns to the surface.

Once the zone of interest is identified it is necessary to establish an understanding of the zone's ability to produce fluids. Production testing is accomplished by performing a prior art drill stem test or DST to establish the performance or productivity of a zone of interest in a formation.

For the DST, the wellbore is sealed above and below the zone of interest using packers. In order to set the packers, the rig must first trip out the drilling string and bit to allow a test tool to be attached to the bottom of the drill string. The drill string and tool is then reinserted into the wellbore. String weight is applied to expand the packers. Ports are opened in the tool exposing recorders to the pressure in the formation. Pressure and time are recorded for a variety of conditions, for example: initial hydrostatic (mud column) pressure, closed in pressure, flowing pressure when the tool is opened, final flowing pressure before closing the tool, closed in pressure and final hydrostatic pressure. After the test, the drill string must be tripped out of the well again to remove the tool and then run in again for reinserting the drill bit should the operator wish to continue drilling.

This DST is a time consuming and expensive process resulting in loss of valuable drilling time. Typically each trip out of the wellbore and back in can take a day meaning a loss of two days each time a DST is ordered. Further, the testing may take another day and DST specialists can cost upwards of $10,000 for each test.

SUMMARY OF THE INVENTION

A method is now provided for determining the productivity of a formation without a requirement to remove the drill string and bit. Compared to the drill stem test, the present invention save two trips, much expense and hours in conducting a productivity test.

In simple terms, the present invention applies a suction technique to the formation to stimulate production using the drilling apparatus—thereby avoiding removal of the drill string and bit. The drill bit is stroked up and down (swabbing), creating a suction in the wellbore and inducing a flow hydrocarbons into the wellbore. In contradistinction to the pressure measurement technique of the DST, the inventive method uses measurement of total hydrocarbon produced during the swab.

In a broad aspect then, a method is provided for testing the productivity from a zone of interest in a formation comprising the steps of positioning the drill bit at the bottom of the zone of interest, circulating drilling fluid through the zone until substantially no hydrocarbon gas is detected therein, rapidly stroking the drill bit, so as to create suction and cause hydrocarbon production from the zone, circulating drilling fluid through the zone and measuring the quantity of produced hydrocarbon gas therein for establishing measures of the formation's productivity, preferably by comparing it against predetermined relationship of TG gas produced and actual production.

Preferably, the detection of hydrocarbon is performed with a total gas sensor applied to gas liberated from the drilling fluid. More preferably, the bit is swabbed up and down a plurality of times for inducing production despite a certain wellbore resistance, such as that due to filter cake or mud invasion.

DETAILED DESCRIPTION OF THE PREFERRED EMBODIMENT

The present invention provides a replacement for the prior art drill stem test, utilizing a piston-like stroking movement of the drill string (swab testing) without removal from the wellbore and measurements of gas production made at the surface of the well. In comparison to the drill stem test, the swab test is expected to take about one-half hour to one hour to complete.

Figure 1:
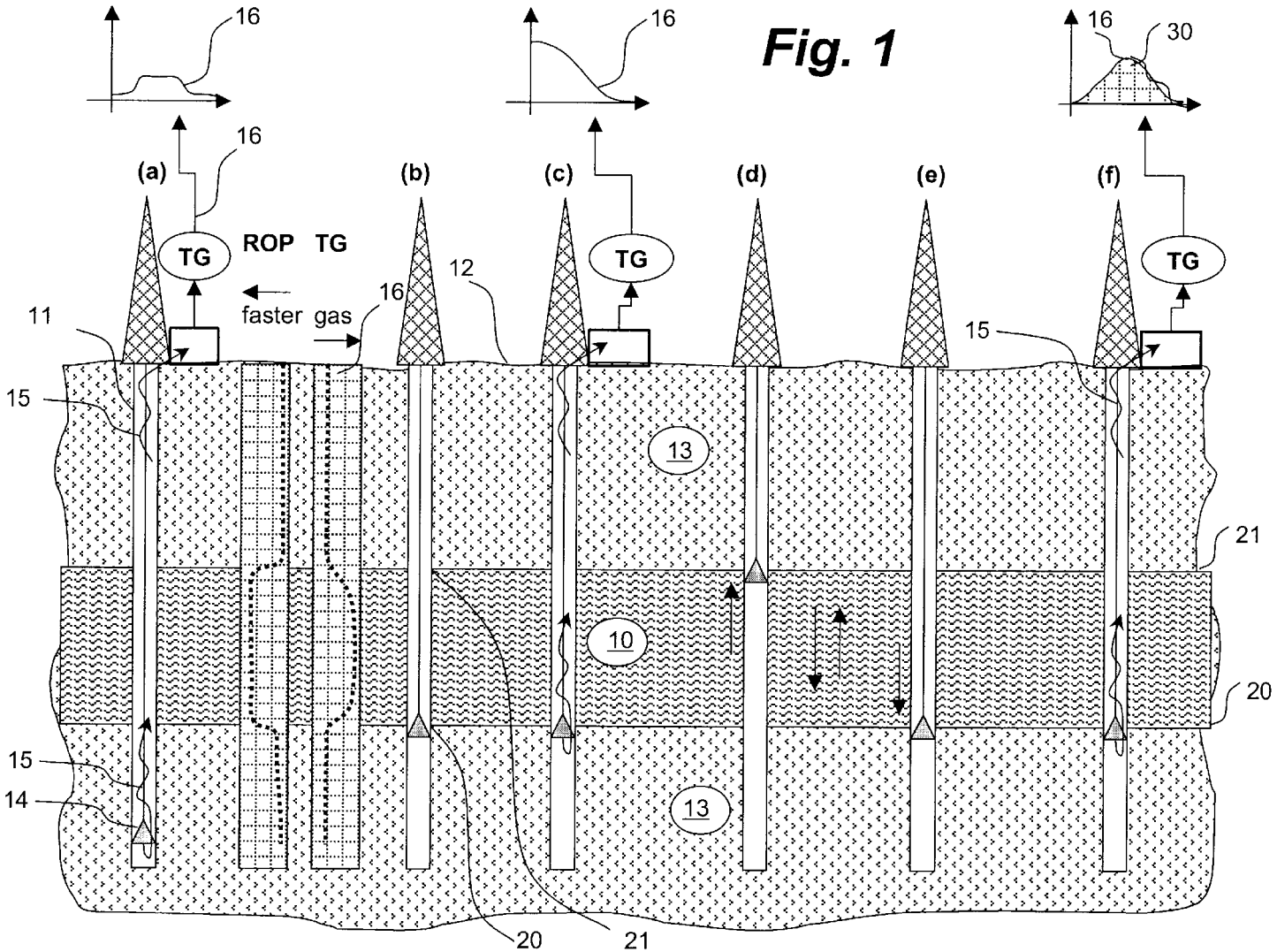
FIG. 1 is a schematic representation of a formation into which a single wellbore has been drilled. Six representations of the same wellbore are illustrated in different stages of a swab test procedure. More particularly, conclusion of drilling, lifting to the zone, depleting gas from the mud, one swab up, then one swab down (of a possible plurality of swabs), and a second swab up for sampling gas in the mud.

Having reference to FIG. 1, the first step prior to the swab test procedure is to identify a formation or zones of interest 10 during drilling of a wellbore 11 from the surface 12 and through non-hydrocarbon-bearing strata 13 using a drill bit 14. A zone 10 is identified by analysis at the surface 12 such as by detection of hydrocarbon gas 16 in the drilling fluid or mud 15 using a total gas detector (TG) or using an increase in the rate of penetration (ROP). Once a zone of interest 10 is identified, the swab test can be performed.

The basic concept of the swab test is to initiate a small amount of production out of the zone of interest 10, which can be measured in drilling mud 15 by detectors at the surface. Rather than the DST measurement of pressure due to production, the swab test utilizes a measurement of actual hydrocarbon production for assessing the productivity of the zone 10. The produced hydrocarbons are carried by drilling mud 15 to the surface measuring devices. Accordingly, drilling mud 15 is pumped down the wellbore and back to the surface, in an active circulating mud system, bringing with it any gas or hydrocarbons produced from the zone of interest as a result of the swab test.

Briefly, typically hydrocarbons are detected using a measuring device known as a Total Gas ("TG") instrument or detector. Should hydrocarbon gas 16 be encountered during drilling, it becomes incorporated with the circulating drilling fluid or mud 15 and is conveyed to the surface and to a mud tank. An agitator, placed in the mud stream, causes contained gas 14 to be liberated from the mud 15. The liberated gas 16 is directed past the Total Gas detector. For producing a continuous gas trace, it is generally known to use a catalytic, rare earth or hot wire gas sensor as the Total Gas detector. The sensor detects the presence of combustible gases. These devices are also called explosimeters and indicate the relative fraction of volatile hydrocarbons in a gas steam. The gas flow and gas composition affects the heat dissipation from the sensor. Heat or power dissipation results in a change in the resistance of the sensor, which is then related to relative concentrations of hydrocarbons.

Turning to the method of the invention, the key is to create production from the formation by lifting the drill bit 14 quickly in the wellbore 11 like a piston in a cylinder. The lifting action induces a slight suction in the wellbore 11 in the area about the zone of interest 10. Suction can only be created if sufficient differential pressure is developed when the bit 14 is lifted. Accordingly, it is important to lift the bit as rapidly as possible, for example, at about 2–3 seconds for about 8 meters of lift. To stimulate or induce production, it is important that a lower pressure be formed in the wellbore 11 than exists in the zone 10.

Production from the zone 10 is impeded at the wellbore 11 if there has been excessive coating of the surface of the wellbore by filter cake or invasion by the drilling mud 15 into the formation. Invasion displaces the hydrocarbons away from the wellbore and filter cake prevents hydrocarbons from flowing through the normally porous formation rock. If the drilling process passed the zone of interest 10 one or two hours previously, then several hours of invasion may have occurred. If this is the case, it may be necessary to raise and lower the bit 14 at least three times (three swabs) to induce production. Simply, the longer the duration available for invasion, the greater will be the resistance of the wellbore to produce and thus it may be necessary to perform a greater number of swabs.

Before swabbing, the drill string and bit must be placed in the zone of interest. The depth of the zone of interest is determined by calculating the lag time required to bring the mud 15 to the surface, the time at which the gas show was detected and the and associating that with the location of the drill bit in the formation.

Figure 2:
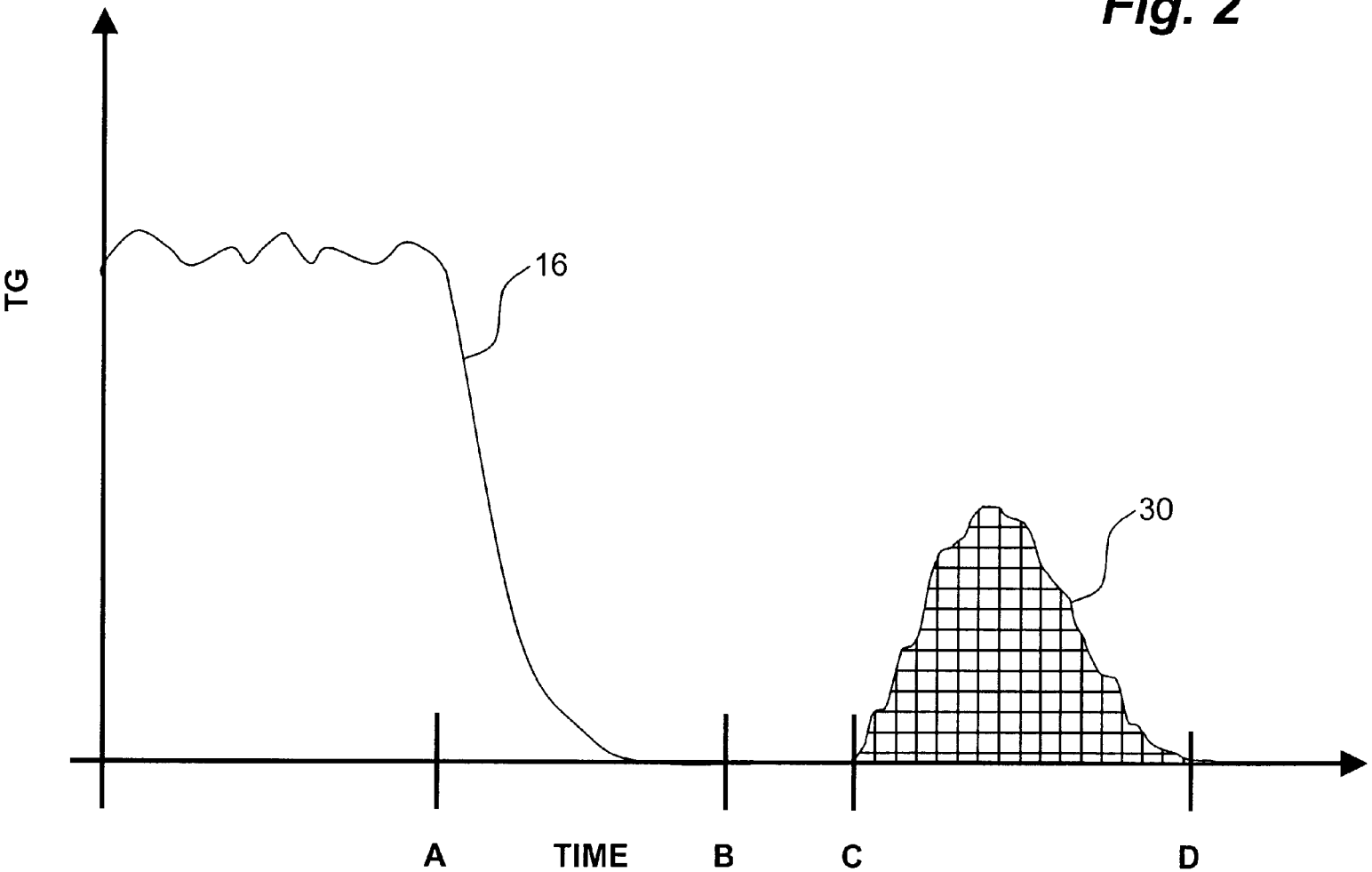
FIG. 2 is a graphical representation of the relationship between gas measurement and time, measured throughout the swab test procedure.
Figure 3:
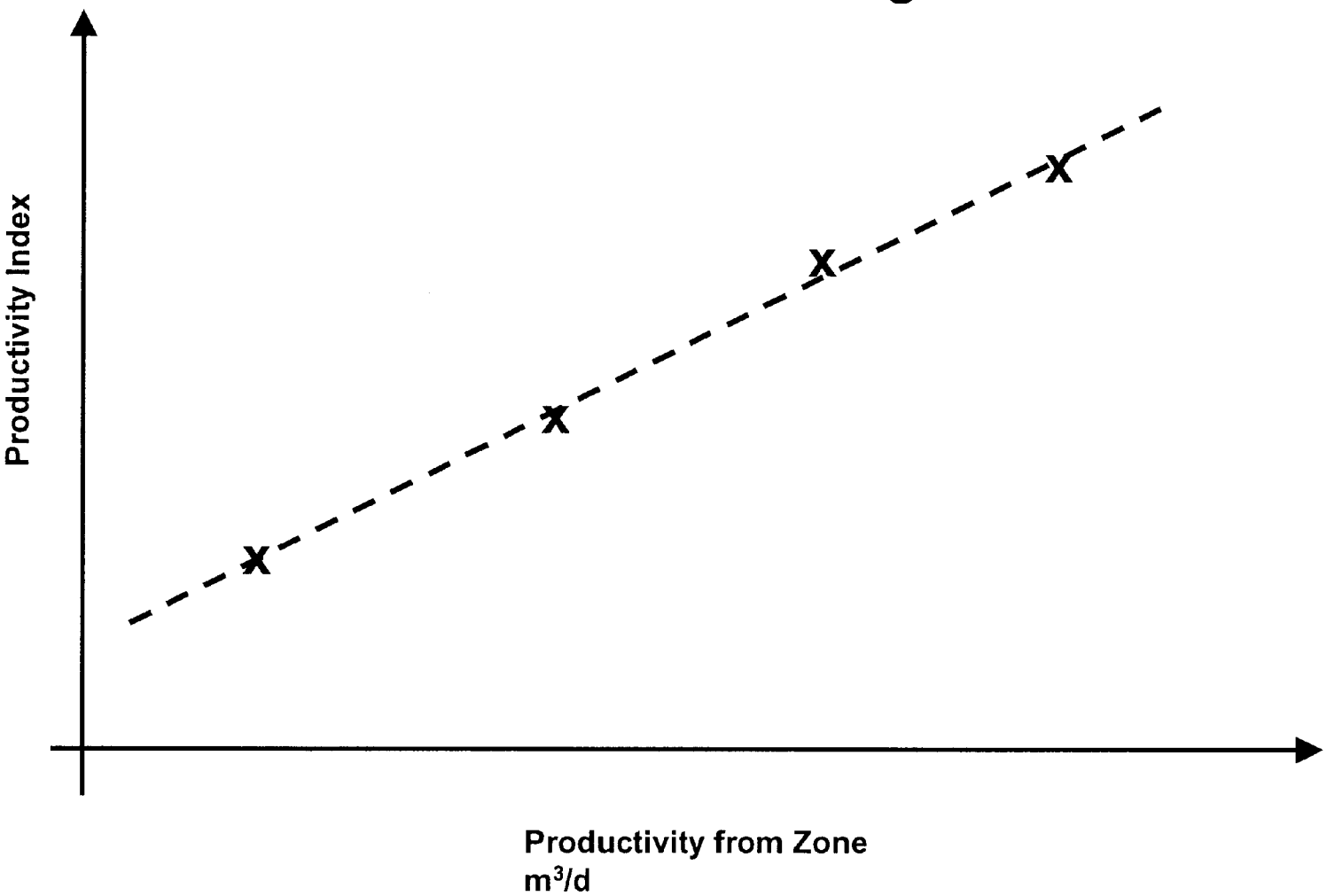
FIG. 3 is a graphical representation of the relationship between the productivity index resulting from the swab test procedure and actual zone production in cubic meters per day.

Having reference to FIG. 1, swabbing is accomplished in the following manner:

(a) drill through the overburden until a TG indication of hydrocarbon identifies a zone of interest 10;

(b) position the drill bit 14 at the bottom 20 of the zone of interest as determined through the analysis utilizing lag time, drill logs and rate of penetration data;

(c) circulate mud 15 down the wellbore 11, through the zone 10, and back to the surface 12 to deplete gas (FIG. 2 A–B) in the wellbore until substantially no further change in hydrocarbon gas detection is measured at the TG. (typically about 10 minutes) and then stop circulating mud 15 (FIG. 2 at B);

(d) hoist, or lift the bit 14 rapidly to the top 21 of the zone of interest 10. (typically a lift should take about three seconds for eight to 10 meters of formation) (FIG. 2 B–C);

(e) reposition the bit 14 to the bottom 20 of the zone (FIG. 2 at D);

for a usual amount of filter cake, one can repeat the rapid lift—possibly twice more depending on the length of time (an example of typical time for three successive lifts, not including lowering time, would be 3.0+2.5+3.2=7.7 seconds); and (f) leaving the bit at the bottom 20 of the swab stroke, mud 15 is again circulated down the wellbore 11, through the zone 10 and back to the surface 12 while measuring production of TG gas 16 until no further indication of hydrocarbon is measured (usually a further 10 minutes) (D).

Referring specifically to plotted TG gas versus time in FIG. 2, between A and B, mud 15 is circulated and gas 16 contained therein is depleted. Between B and C, the swabbing is performed. Then mud 15 is recirculated again to collect the hydrocarbon gas 16 produced from the swabbing. The area 30 between the resulting curve between C to D is indicative of the hydrocarbon productivity of the formation.

The area under the gas detection curve (C to D) is calculated in parts per million (ppm) measured over time. This area is proportional to the actual production from the formation; the greater the area, the greater the production. The area calculated is used as a relative production index.

The production index is compared against pre-determined values for actual production from a zone 10. The results, as shown in FIG. 5, demonstrate a strong correlation between the two values.

In cases where the zone 10 is deeper than about 8 to 10 meters, the drill bit 14 can not be raised through the entire zone rapidly enough to produce adequate suction to cause production. In this case, the zone 10 is divided into sections of approximately 8–10 meters and each of the sections is tested in sequence. Testing using the above procedure is performed at the bottom section of the zone first and then at each successive upward section. This order of testing prevents errors which would be incurred due to gas from lower sections, through release from the suction created in the upper sections, resulting in falsely elevated production indices.

The swab test procedure provides relative production indices that correlate strongly with actual well production. The swab test requires a fraction of the time required for the prior art drill stem test, resulting in a quick return to drilling or completion of the well. Costs are minimized as equipment used for the test is already in place, as part of routine drilling and testing procedures.

THE EMBODIMENTS OF THE INVENTION FOR WHICH AND EXCLUSIVE PROPERTY OR PRIVILEGE ARE DEFINED AS FOLLOWS:

What is claimed is:

1. A method of testing the productivity from a zone of interest in a sub-surface formation after drilling a wellbore from surface and to the zone with a drill bit, drilling fluid being capable of being circulated from the bit and up the wellbore to the surface, comprising the steps of:

(a) positioning the bit at a first position low in the zone;

(b) circulating drilling fluid through the zone and to the surface and continuing to circulate drilling fluid to deplete hydrocarbons in the drilling fluid until substantially no further change is detected therein;

(c) rapidly stroking the drill bit upwardly to a second position in the zone above the first position, at least one time, so as to create suction in the wellbore and induce hydrocarbon production from the zone;

(d) repositioning the bit at the first position low in the zone;

(e) circulating drilling fluid through the zone and to the surface while measuring the quantity of hydrocarbon gas produced therein for establishing formation productivity.

2. The method as recited in claim 1 wherein the first position is at the bottom of the zone and the second position is at the top of the zone.

3. The method as recited in claim 1 wherein the wellbore at the zone has suffered invasion further comprising the steps of:

(a) rapidly stroking the drill bit upwardly from the first position to the second position;

(b) repositioning the bit at the first position low in the zone;

(c) repeating the stroking and repositioning steps as many times as necessary to overcome the invasion.

4. The method as recited in claim 3 wherein the zone has a depth greater than the ability of the drill bit to induce a suction in one stroke further comprising the steps of:

(a) positioning the bit at a first position, circulating drilling fluid to deplete the hydrocarbons, rapidly stroking the drill bit upwardly to the second position and repositioning the bit at the first position at least one cycle, and then circulating drilling fluid for measuring the quantity of hydrocarbon gas produced therein for establishing formation productivity between the first and second positions; then (b) repeating the preceding procedure for the zone between the second position and a third position in the zone above the second position.

5. The method as recited in claim 2 wherein the bit is stroked upwardly between the first position and the second position at a speed of about 8 meters every 3 seconds.

6. The method as recited in claim 3 wherein the bit is stroked upwardly between the first position and the second position at a speed of about 8 meters every 3 seconds.

7. The method as recited in claim 4 wherein the bit is stroked upwardly between the first position and the second position at a speed of about 8 meters every 3 seconds.

* * * * *